United States Patent [19]

Worth et al.

[11] 4,269,602

[45] May 26, 1981

[54] BUFFERED NON-FORMALDEHYDE DURABLE PRESS TEXTILE TREATMENT

[75] Inventors: Daniel L. Worth, Greenwood; Ernest A. Freeman, Jr., Ware Shoals, both of S.C.

[73] Assignee: Riegel Textile Corporation, New York, N.Y.

[21] Appl. No.: 36,641

[22] Filed: May 7, 1979

[51] Int. Cl.[3] ..... D06M 13/2; D06M 15/30

[52] U.S. Cl. ..... 8/116.4; 8/115.6; 8/DIG. 1; 8/DIG. 17; 252/8.6; 260/29.2 M; 427/387; 427/393.2

[58] Field of Search ..... 8/116.4, DIG. 17, 115.6, 8/DIG. 1; 427/393.2, 387; 260/29.2 M; 252/8.6

[56] References Cited

U.S. PATENT DOCUMENTS

| | | | |
|---|---|---|---|
| 2,412,832 | 12/1946 | Pfeffer et al. | 8/115.6 |
| 2,436,076 | 2/1948 | Pfeffer et al. | 8/116.4 |
| 2,530,175 | 11/1950 | Pfeffer et al. | 8/116.4 |
| 2,541,457 | 2/1951 | Beer | 8/116.4 |
| 2,574,114 | 11/1951 | Lehmann et al. | 8/116.3 |
| 2,622,960 | 12/1952 | Woods et al. | 8/116.4 |
| 2,679,449 | 5/1954 | Schappel | 8/116.4 |
| 3,312,521 | 4/1967 | Stenner | 8/116.4 |
| 3,357,784 | 12/1967 | Kasper | 8/116.4 |
| 3,663,974 | 5/1972 | Watanabe et al. | 8/116.4 |
| 3,954,405 | 5/1976 | North et al. | 8/186 |
| 3,979,178 | 9/1976 | Reinhardt | 8/185 |
| 3,989,457 | 11/1972 | Marte | 8/116.4 |
| 4,028,054 | 6/1977 | North et al. | 8/186 |
| 4,076,870 | 2/1978 | Yamamoto | 8/116 R |
| 4,116,625 | 9/1978 | Yamamoto | 8/116 R |

FOREIGN PATENT DOCUMENTS

| | | |
|---|---|---|
| 439294 | 6/1934 | United Kingdom . |
| 585679 | 1/1944 | United Kingdom . |
| 586598 | 3/1944 | United Kingdom . |
| 586637 | 3/1944 | United Kingdom . |
| 695703 | 10/1949 | United Kingdom . |
| 744991 | 1/1953 | United Kingdom . |

OTHER PUBLICATIONS

"The Effect of Additives to Thermosetting Resin Baths on Phys. Prop. of the Treated Fabric" American Dyestuff Rep. 11-7-55; 791-794 Garvey.

"The Effect of Silicone Softeners . . . " Textile Res. J. Jan. 1958 pp. 170-179 Simpson.

"Dialdehydes on Cotton Cellulose Cross-Linkers" Textile Res. J. 3-58; pp. 257-262 Hurwitz et al.

"Crease Resist . . . Polysiloxane Emulsion Treatment" Amer. Dyestuff Rep. 5-28-62 vol. 51 #11 pp. 29-33 Beninate et al.

Derwent Abs 78810 Y/44 Dainippon Ink Chem. J77039-958 "Resin Coating Cellulose Fibers . . . " 10--7-77.

Derwent Abs 630342 (Belgium) Courtaulds Lts G. Brit. 12236/62 "Modification of Cellulose Fibers".

Derwent Abs. 21548W/13 Toyobo Co Ltd. J49080388 "Wrinkle-Resistant Cellulose Fiber . . . "12-2-72.

Turner et al., "Finishing Cotton/Polyester Knits" vol. 8 #9 pp. 50-53 Sep. 1976 Textile Chemist & Colorist.

"A Water-Rep. Crease-Resistant Finish . . . " Agric. Res. Serv. Aug. 1963 Conner.

"Abrasion Resist DP Cottons" Textile Indust. Sep. 1966, Reeves et al.

"Cross Linked Silicone Films in Textile Finishing" Text. Res. Tous. 4-1967 pp. 324-333 Welch et al.

Crosslinking Cotton Cellulose with Gloxal Res. Prod." Amer. Dyestuff Rep. 2-10-69 pp. 27-29 Gonzales et al.

"Formaldehyde's Role in Durable Press Fabrics Seems Likely to Fade" Daily News Record, Monday 2-5-79 Braham Norwich.

"Tris Whistle-Blower Hits Anew; This Time It's Formaldehyde" Daily News Record Wed. 4-4-79 R. Wightman.

*Primary Examiner*—Joseph L. Schofer

*Assistant Examiner*—Herbert J. Lilling

*Attorney, Agent, or Firm*—Bell, Seltzer, Park & Gibson

[57] ABSTRACT

This invention relates to a durable press treatment for textile fabrics containing cellulosic fibers and which is characterized by avoiding the use of formaldehyde and problems associated therewith. The fabric is impregnated with a formaldehyde-free finishing agent containing glyoxal, reactive silicone, a catalyst and a buffering agent for reducing the acidity of the fabric. The fabric is thereafter dried and the finishing agent is cured to impart durable press properties to the fabric.

19 Claims, 1 Drawing Figure

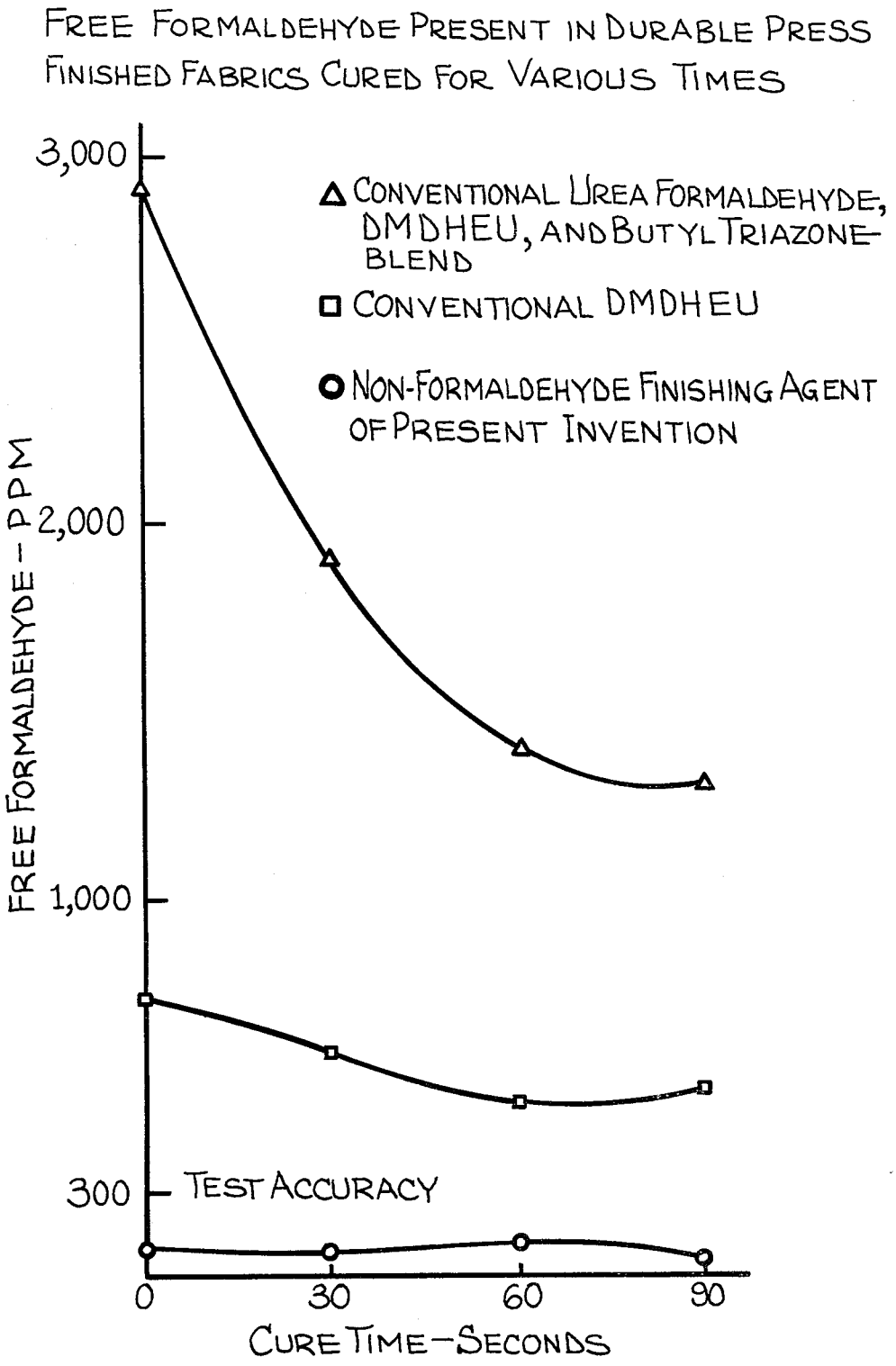
FREE FORMALDEHYDE PRESENT IN DURABLE PRESS FINISHED FABRICS CURED FOR VARIOUS TIMES
3,000
2,000
1,000
300
FREE FORMALDEHYDE - PPM
CONVENTIONAL UREA FORMALDEHYDE, DMDHEU, AND BUTYL TRIAZONE BLEND
CONVENTIONAL DMDHEU
NON-FORMALDEHYDE FINISHING AGENT OF PRESENT INVENTION
TEST ACCURACY
0
30
60
90
CURE TIME—SECONDS

BUFFERED NON-FORMALDEHYDE DURABLE PRESS TEXTILE TREATMENT

CROSS-REFERENCE TO RELATED APPLICATION

This invention relates to a further improvement in the invention disclosed in commonly-owned U.S. application Ser. No. 36,035 of Daniel L. Worth, filed concurrently herewith, and entitled NON-FORMALDEHYDE DURABLE PRESS TEXTILE TREATMENT.

FIELD OF THE INVENTION

This invention relates to an improved buffered non-formaldehyde durable press finish for textile fabrics and to a novel and advantageous process for imparting durable press properties to a textile fabric characterized by avoiding the use of formaldehyde or formaldehyde-based compounds. The present invention also relates to durable press textile fabrics of reduced acidity treated with said non-formaldehyde finish.

BACKGROUND OF THE INVENTION

Formaldehyde has been used in the textile industry for a number of years in a variety of applications. Perhaps one of its widest uses is as an ingredient in durable press finishes for fabrics containing cellulosic fibers. Recently, however, there has been increasing concern over safety and health hazards presented by the use of formaldehyde. It has been determined that exposure to formaldehyde on fabrics or in the air can cause allergic reactions in some persons. It has even been suggested that formaldehyde may be a carcinogenic or mutagenic agent.

Because of this concern, efforts are being made in the United States, as well as in foreign countries, to reduce or eliminate formaldehyde usage wherever possible, including textile uses. In the United States, the amount of formaldehyde which can be discharged into waste water streams is limited by governmental regulation, as is the amount of exposure which workers may have to formaldehyde vapors in the air. In Japan, concern over the safety of formaldehyde has led to strict regulations prohibiting any free formaldehyde in apparel for children under two years of age and setting limits on the amount of formaldehyde which may be present in adult apparel. It is anticipated that in the near future, other countries may also enact restrictions or prohibitions on the use of formaldehyde in textile finishing.

Presently, all of the commercial durable press treatments for textile fabrics require formaldehyde or formaldehyde-based compounds. Typically, durable press treatments use methylol derivatives cyclic ureas or methylol carbamates, of which the following are examples: dimethylol ethylene urea (DMEU), ethyl carbamate, and dimethylol dihydroxyethylene urea (DMDHEU). DMDHEU, sometimes called glyoxal resin, is perhaps the most commonly used durable press finishing agent and is formed by reacting urea, formaldehyde and glyoxal. The methylol group ($—CH_2—OH$) of all of these durable press agents is formed by formaldehyde and is the group that cross-links with cellulose to give durable press properties. There is no way to prevent some formaldehyde from being released when this cross-linking (curing) occurs. In addition, some free formaldehyde usually remains in the cured fabric. If the residual free formaldehyde is to be removed from the fabric, an after-washing operation is required, but even this is not always totally effective.

Intensive efforts are being made both in the United States and abroad to develop a durable press treatment which eliminates formaldehyde or formaldehyde-based compounds and at least one non-formaldehyde durable press treatment has recently been proposed. Recent U.S. Pat. No. 4,116,625 discloses a non-formaldehyde durable press finish based on imidazoline derivatives combined with acrylic or methacrylic glycidyl containing polymers. It is reported, however, that this process is more expensive and less effective than processes based on formaldehyde, and requires powerful acid catalysts which are of questionable safety.

Therefore, at the present time no commercially acceptable alternatives to formaldehyde-based durable press finishes have been introduced, and formaldehyde is regarded as a "necessary evil" in durable press finishes. The primary approach to the formaldehyde problem has thus been to attempt to reduce formaldehyde levels. Various approaches have been employed, such as varying the catalyst systems used or reducing the amount of formaldehyde-based resin in the finish by employing a resin extender, such as silicone. These approaches are not very effective, however, and the formaldehyde levels in the finishing plant and in the fabric remain undesirably high.

SUMMARY OF THE INVENTION

The aformentioned commonly-owned copending application discloses a durable press treatment which has succeeded in eliminating any dependence on the use of formaldehyde or formaldehyde generating chemicals, and thus avoids the attendant problems and hazards of formaldehyde in the finishing operation and in the finished fabric. This non-formaldehyde durable press treatment uses as fiber treating agents a mixture of two readily available materials, glyoxal and reactive silicon to achieve durable press fabric properties which are comparable, if not superior, to those obtained by conventional formaldehyde-based durable press treatments. The treatment method can be carried out at a competitive cost and on the same apparatus which is used for conventional formaldehyde-based durable press treatments.

The present invention provides an improvement in the non-formaldehyde durable press treatment of said copending application by incorporating in the non-formaldehyde durable press finish formulation with the glyoxal and reactive silicone, an additional agent serving as a buffering agent for reducing the acidity of the finished fabric.

In some instances it has been observed that when glyoxal and reactive silicone are used as fiber treating agents, the finished fabric is slightly acid. While this acidity does not adversely affect fabric physical properties or durable press performance, some customers find it undesirable and prefer that the fabric be more nearly neutral in pH. While excess acidity can be easily removed by after-washing, it is desirable to avoid the necessity of this additional step and the attendant expense of another drying operation.

Thus, in accordance with the present invention, a textile fabric formed at least partially of cellulosic fibers is impregnated with a formaldehyde-free finishing agent containing glyoxal, reactive silicone, a catalyst, and a buffering agent. The fabric is then dried and cured to impart durable press properties to the fabric.

The term "buffering agent" is used herein to describe a compound or mixture of compounds which, when incorporated in the aqueous non-formaldehyde durable press finish formulation, results in reducing the acidity of the cured durable press finished fabric. It is believed that the buffering agent functions to moderate the strongly acid characteristics of the glyoxal by forming a buffer system in the finish formulation. However, regardless of the actual mechanism or theory by which its function is accomplished, it should be understood that the essential purpose of the buffering agent is to decrease the acidity of the finished fabric without counteracting the ability of the fiber treating agents in imparting durable press properties to the fabric.

The fiber treating agents which are used in the present invention have each been used individually in textile finishing applications. Reactive silicone, for example, is commercially sold as a softener and resin extender for use in combination with formaldehyde-based durable press resins to reduce the amount of resin required while also imparting desirable hand properties to the finished fabric. The silicone is thus used as an additive to a resin which itself has the capability of imparting durable press properties to the fabric. By way of example, the effect of silicone on resin treated cellulosic fabrics is considered by Simpson in *Textile Research Journal*, February 1958.

Glyoxal, as noted earlier, has previously been used as an ingredient in a formaldehyde-based durable press resin. Additionally, several early patents disclose the use of glyoxal for dimensionally stabilizing or shrink-proofing fabrics made of regenerated cellulose, as for example the Pfeiffer, Jr., et al U.S. Pat. Nos. 2,412,832; 2,436,076 and 2,530,175.

It is recognized by those knowledgeable in the field of textile finishing that although glyoxal has utility in some applications for shrink-proofing, it is ineffective in imparting durable press properties to a fabric. Additionally, it is also known that the use of glyoxal has undesirable side effects and results in severe loss of fabric strength.

It has been now discovered, however, that although reactive silicone and glyoxal are each ineffective by themselves as a durable press agent, their combined use as fiber treating agents imparts effective durable press properties to a fabric and, most significantly, for the first time makes it possible and practical to provide durable press properties in a fabric without the use of formaldehyde or formaldehyde-generating chemicals.

DESCRIPTION OF THE DRAWING

The drawing is a graph comparing the amount of free formaldehyde present in fabrics treated with two conventional formaldehyde-based durable press resins and with the non-formaldehyde durable press finishing agent of the present invention. Free formaldehyde (in parts per million) is plotted against curing time in seconds.

The amount of free formaldehyde in the fabric was determined by the Sealed Jar Method (AATCC Test Method 112-1978). This test method is intended to detect free formaldehyde over a range from about 300 ppm, which is undetectable by the nose, to about 3500 ppm, which is very odoriferous.

The curve indicated by triangles, which shows the highest amount of free formaldehyde, is a commercially available resin which is a blend of urea formaldehyde, DMDHEU, and butyl triazone. The curve indicated by squares is a commercially available DMDHEU (glyoxal formaldehyde-based resin) product. The curve indicated by circles is the non-formaldehyde durable press finishing agent of the present invention. As seen in the graph, the small level of free formaldehyde measured in the non-formaldehyde samples is well below the minimum sensitivity of the current standard test method for formaldehyde detection. Work directed toward a more accurate test method for determination of very small amounts of formaldehyde is continuing.

Durable press fabrics produced in accordance with the present invention are thus essentially free of formaldehyde. Any formaldehyde which might be found in the fabric would be attributable either to impurities present in the glyoxal or other reactants, degradation of the glyoxal, or pick-up from formaldehyde vapors present in the air. There is no purposeful addition of formaldehyde to the finish formulation.

DETAILED DESCRIPTION OF THE INVENTION

The non-formaldehyde durable press treatment of the present invention is applicable to textile fabrics which are formed at least partially of cellulosic fibers, such as cotton and synthetic fiber blend fabrics as well as 100% cotton fabrics.

The finishing agent may be applied to the fabric in the same manner that conventional formaldehyde-based durable press finishes are applied, such as for example by impregnation with an aqueous bath or foam of the finishing agent. The fabric is then dried and thereafter cured by heating.

The invention is applicable for producing both precured and postcure fabrics. As is well known, precured fabrics are cured during the finishing operation, usually immediately following drying of the impregnated fabric. In postcure fabrics, the fabric is impregnated with the finishing agent and dried, but the curing is performed at a later time, usually after the fabric has been cut and formed into garments.

In a preferred method of application, the fabric is impregnated by padding with an aqueous bath of the non-formaldehyde finishing agent to obtain a wet pick-up of about 45 to about 100 percent by weight. The fabric is then dried on a tenter frame operating at an elevated temperature of up to about 300° F. If the fabric is to be postcured, it is dried to a moisture content of about five to ten percent and then removed from the tenter frame. If the fabric is to be precured, curing may be carried out on the tenter frame immediately following drying by heating the fabric in a curing chamber at a temperature of about 350°–400° F. for up to about two minutes until sufficiently cured. Following curing, the fabric may be subjected to an after-washing operation if desired.

Glyoxal for use in the present invention is available in commercial quantities as an aqueous solution, usually about 40 percent concentration.

The reactive silicone materials which may be suitably employed in the present invention are available from various manufacturers. These materials are designed and sold for use as softening agents and durable press resin extenders for textile finishing applications. They generally are available as stable reactive organosilicone emulsions which are readily dilutable with water. Manufacturers sometimes recommend that the reactive silicone material be used in conjunction with cross-linking additives, such as silane, but when employed pursuant to the present invention, the cross-linking additive is not essential. Suitable results have been observed both with and without use of the recommended cross-linking additives. Illustrative, but non-limiting examples of suitable reactive silicones include General Electric Silicone Softener/Resin Extender SM2129, Dow Corning 1111 Silicone Emulsion, Union Carbide Y-9224 Silicone Emulsion and General Electric Silicone Softener/Resin Extender XM-124-5557.

The glyoxal and reactive silicone fiber treating agents are applied to the fabric in the presense of a catalyst. Catalysts suitable for use with conventional formaldehyde-based durable press resins may also be used with the non-formaldehyde finishing agent of the present invention. Conventional durable press catalysts include metal salt catalysts, latent catalysts, and acid or acid salt catalysts. Illustrative, but non-limiting examples of such catalysts include the following: zinc fluoborate, ammonium chloride, magnesium chloride, ammonium phosphate, ammonium sulfate, amine hydrochlorides, and zinc nitrate.

A number of the conventional durable press catalysts, when used with the non-formaldehyde durable press finishing agent of the present invention, have been found to cause discoloration or change of shade in the fabric when allowed to remain on the fabric following curing. However, these catalysts may be suitably used with the present invention with no adverse effect when the fabric is subjected to an after-washing operation following curing, since the catalysts are removed from the fabric by the after-washing treatment.

It has been found, however, that the undesirable after effects produced by some of the conventional durable press catalysts may be avoided by using as a catalyst in the present invention a metal sulfate salt. Particularly suitable as a catalyst is a metal sulfate blend which comprises a mixture of aluminum sulfate and magnesium sulfate in substantially equal proportions.

The improvement of the present invention involves incorporating in the non-formaldehyde durable press finish formulation an additional agent for reducing the acidity of the finished fabric. This additional agent is referred to herein as a buffering agent since it is believed to form a buffer system in the aqueous finish formulation which results in moderating the strongly acid characteristics of the glyoxal in the finished fabric. However, regardless of the actual theory or chemical mechanism by which the agent operates, the function of the agent is to decrease the acidity of the finished fabric, and it is highly important that this be accomplished without counteracting the ability of the glyoxal and reactive silicone fiber treating agents for imparting durable press properties to the fabric.

Illustrative but non-limiting examples of compounds which have been found suitable as agents for decreasing the acidity of the finished fabric include sodium hydrogen phosphate, sodium dihydrogen phosphate, potassium carbonate, sodium carbonate, potassium citrate, sodium citrate, sodium oxalate, sodium acetate, sodium tartrate, borax, sodium metaborate, and mixtures of two or more of these salts. A preferred class of such agents are the alkali metal salts of weak acids.

These compounds are used in relatively small amounts in the non-formaldehyde finish formulation. The amount of the compound used depends upon the characteristics of the particular compound, the amount of glyoxal in the finish formulation and the final fabric pH desired. Preferably, it is used in an amount sufficient to achieve a pH of at least 4, and preferably 4.5 in the finished fabric. Typically, this represents about 20 to 60% by weight buffering agent, based on the solids content of the glyoxal.

It has been observed that certain salts which are useful as buffering agents may reduce the effectiveness of the fiber treating agents in providing durable press properties, and for this reason, the buffering agent is preferably used in the smallest amount possible which provides adequate reduction in acidity.

It is also believed that certain of the buffering agents may also in some way interact with the catalyst, lessening its effectiveness and thus resulting in a reduction in durable press performance. Additionally, certain of the buffering agents have in some instances been observed to cause discoloration or change of shade in the fabric.

After extensive investigation of numerous possible buffering agents and combinations thereof, it has been determined in accordance with the present invention that sodium metaborate octahydrate is a highly effective agent for reducing the fabric acidity and the preferred agent for use in the non-formaldehyde durable press formulation of the present invention. This compound also avoids undesirable side effects such as fabric discoloration or change of shade. Additionally, when this compound is used in combination with the preferred metal sulfate blend catalyst described above, very little interference or interaction with the catalyst is observed.

The formaldehyde-free finishing agent of the present invention may optionally include small amounts of a wetting agent for facilitating the wetting and penetration of the finishing agent into the fabric. Particularly suitable as wetting agents are nonionic surfactants such as ethoxylated decyl alcohols, ethoxylated nonyl alcohols, ethoxylated secondary alcohols, and alkylaryl polyether alcohols. Illustrative but non-limiting examples of suitable commercially available wetting agents are: Triton X-100, a product of Rohm and Haas, and MYKON NRW, available from Sun Chemical Corporation.

Other conventional textile finishing modifiers or additives may be incorporated in the formulation, if desired, including hand builders or hand modifiers such as polyvinyl acetate or acrylic resins, softeners, soil release agents, etc.

The glyoxal and reactive silicone fiber treating agents have been found to be effective in providing durable press properties at very low concentration levels on the fabric. In some instances, for example, acceptable durable press properties have been achieved with as little as one-third of one percent glyoxal or as little as one-fourth of one percent reactive silicone, by weight based on the dry weight of the fabric. However, concentrations somewhat higher than this are usually preferred in order to obtain consistently good results. The upper limit on the amount of glyoxal and silicone is primarily a practical limit dictated by economics. Fabrics properties and durable press performance are not significantly improved by increasing the concentration levels of the fiber treating agents above the preferred levels, but no adverse effects on durable press properties are observed.

The preferred concentration levels of the fiber treating agents vary depending upon the fiber content, the weight and construction of the fabric, and on other factors. Fiber blend fabrics, such as cotton and polyester fiber blends, for example, will require a lower concentration level of fiber treating agents than fabrics formed wholly of cotton fibers to achieve comparable durable press properties.

For the range of fiber contents, fabric styles, weights, and constructions which are normally encountered, it has been found desirable to apply to the fabric a glyoxal concentration within the range of about one to about eight percent and a reactive silicone concentration within the range of about one-third of one percent to about one percent, by weight based on the dry weight of the fabric.

For synthetic fiber and cotton blend fabrics containing up to about fifty percent cotton fibers, a concentration range of about one and one-half percent to about three percent glyoxal and about one-third percent to about two-thirds percent reactive silicone is preferred. For fabrics formed wholly or predominantly of cotton fibers, a higher glyoxal concentration of about three percent to about seven percent is preferred, with the silicone concentration preferably remaining within the range of about one-third percent to about two-thirds percent, by weight based on the dry weight of the fabric.

In the aqueous finishing bath the concentration of the fiber treating agents, catalyst and other ingredients in the aqueous finishing bath may vary depending upon a number of factors, such as the method of application, wet pick-up achieved, desired concentration on fabric, etc. Preferably, however, these materials are present in proportions by weight generally as follows:

| | |
|---|---|
| glyoxal (solids basis) | 100 parts |
| catalyst (active solids basis) | 5–40 parts |
| reactive silicone (solids basis) | 3–75 parts |
| buffering agent (solids basis) | 20–60 parts |
| wetting agent (wet basis) | up to about 15 parts |
| other additives, modifiers, etc. (solids basis) | up to about 200 parts |

A particularly preferred formulation is as follows:

| | |
|---|---|
| glyoxal (solids basis) | 100 parts |
| metal sulfate blend catalyst (active solids basis) | 12 to 23 parts |
| reactive silicone (solids basis) | 18 to 43 parts |
| sodium metaborate octahydrate buffering agent (solids basis) | 30 to 40 parts |
| wetting agent (wet basis) | up to about 15 parts |
| other additives, modifiers, etc. (solids basis) | up to about 200 parts |

The invention is further illustrated by the following examples in which all parts and percentages are by weight unless otherwise indicated. These non-limiting examples are illustrative of certain embodiments of the invention and are designed to teach those skilled in the art how to practice the invention and the best mode contemplated for carrying out the invention.

EXAMPLE 1

A non-formaldehyde durable press finish formulation was prepared as follows:

15.4 lbs. of sodium metaborate oxyhydrate was added directly to about 110.4 lbs. of commercial glyoxal (40 percent aqueous solution) and was stirred and dissolved. The resulting solution contained about 12.4 percent by weight sodium metaborate oxyhydrate. This solution was diluted with about 50 gallons of water, and to the diluted solution was added three lbs. of an ethoxylated decyl alcohol nonionic surfactant (MYKON NRW), 27.5 lbs. of metal sulfate blend catalyst (50/50 mixture of aluminum sulfate and magnesium sulfate at a 30 percent concentration), 46 lbs. of reactive silicone (General Electric Silicone Softener/Resin Extender XM-124-5557) containing 25 percent by weight active solids, and 20 lbs. of polyvinyl acetate hand builder (SEYCO REZ B-47, produced by AZS Chemical Company of Atlanta, Ga.). Water was then added to make a total of 150 gallons of mix.

This finishing bath formulation was piped to a three roll padder and a 65/35 polyester/cotton blend twill weave fabric weighing 7.3 ounces per square yard was directed through the padder where it was immersed in the finishing bath and squeezed to remove excessive finish and provide a wet pick-up of about 61.5 percent. After the finishing bath formulation was applied, the fabric was dried on a tenter frame operating at a temperature of about 250°–300° F.

The percent solids deposited on the fabric was calculated to be as follows (percent by weight, based on the dry weight of the fabric):

| | |
|---|---|
| glyoxal | 2.17% |
| sodium metaborate (hydrated) | 0.24% |
| metal sulfate blend catalyst | 0.34% |
| reactive silicone | 0.57% |

A portion of this fabric was precured while on the tenter frame by directing the same immediately from the drying zone through a curing oven at a temperature of 350°–400° F. for about one minute. Another portion of the fabric was removed from the tenter frame after drying and postcured at a later time by heating at a temperature of about 350° F. for about one minute. Physical properties and durable press performance of both the precured and the postcured fabric were measured using standard AATCC test methods, with the following results:

| Test | | Precured | Postcured |
|---|---|---|---|
| breaking strength, lbs. W. | | 219 | 214 |
| breaking strength, lbs. F. | | 99 | 96 |
| tearing strength, gms. W. | | 6400 | 6400 |
| tearing strength, gms. F. | | 5000 | 5150 |
| finished weight, oz./sq. yd. | | 7.1 | 7.3 |
| construction W. | | 86 | 86 |
| construction F. | | 42 | 43 |
| fabric appearance | | 4 | 4 |
| crease appearance | | — | 5 |
| fastness to: | washing - stain | 3–4 | 3–4 |
| | washing - color chg. | 4 | 4 |
| | chl. blch. - stain | 3–4 | 3–4 |
| | chl. blch. - color chg. | 3 | 3 |
| | light | 3–4 | 3–4 |
| pH of fabric | | 5.1 | 5.1 |
| ppm formaldehyde | | 120 | 125 |

The physical properties of both the precured and the postcured fabrics were fully satisfactory. The fabric smoothness appearance rating of 4 and the crease appearance of 5 represent acceptable durable press performance. The level of free formaldehyde measured in the fabric samples is below the minimum sensitivity of the test method.

The fabric pH of 5.1 was acceptable without the need for an after-wash operation. By comparison, the same finish formulation with the sodium metaborate omitted produced a finished fabric pH of about 3.5, which would ordinarily require afterwashing to reduce fabric acidity.

EXAMPLES 2–6

Samples of a 7.2 ounce/square yard twill weave 65/35 polyester/cotton blend fabric and a 9 ounce/square yard twill weave 50/50 polyester/cotton blend fabric were impregnated with various finish formulations, and were dried and cured under similar conditions. Comparisons of the durable press properties were made by rating the fabric appearance after five home washings (AATCC Test Method 124-1978) and fabric pH was measured. The percent solids deposited on the fabric was calculated for each fabric sample, based upon the finishing bath composition and the percent pick-up. The percent solids on fabric (percent by weight based on the dry weight of the fabric) and the corresponding fabric appearance and fabric pH for each sample were as follows:

| EXAMPLE | 2 | 3 | 4 | 5 | 6 |
|---|---|---|---|---|---|
| fabric (% polyester/ % cotton) | 65/35 | 65/35 | 65/35 | 50/50 | 50/50 |
| wetting agent | .028 | .034 | .034 | .028 | .028 |
| glyoxal | 2.64 | 1.94 | 1.94 | 4.4 | 3.3 |
| sodium metaborate octahydrate | .94 | .69 | .96 | 2.62 | 1.17 |
| metal sulfate blend catalyst | .45 | .36 | .36 | .8 | .56 |
| reactive silicone | .48 | .5 | .5 | .48 | .48 |
| polyvinyl acetate | .46 | .48 | .48 | — | .46 |
| appearance | 4 | 4 | 4 | 4 | 4 |
| fabric pH | 4.6 | 4.9 | 4.9 | 4.5 | 4.35 |

From the foregoing description and examples it will thus be seen that the present invention has provided a practical and effective improved durable press finish formulation and treatment method which has succeeded in eliminating any dependence on the use of formaldehyde or formaldehyde-generating chemicals, and thus avoids the attendant problems and hazards of formaldehyde in the finishing operation and in the finished fabric.

While the invention has been described in considerable detail with reference to certain preferred embodiments thereof, it will be understood that variations and modifications may be made within the spirit and scope of the invention as described above and as defined in the appended claims.

What is claimed is:

1. A process for imparting durable press properties to a textile fabric formed at least partially of cellulosic fibers and characterized by avoiding the use of formaldehyde and problems associated therewith, said method comprising impregnating the textile fabric with a formaldehyde-free finishing agent containing glyoxal, reactive silicone, a catalyst, and a buffering agent for reducing acidity in the treated fabric, and thereafter drying the fabric and curing the finishing agent to impart durable press properties to the fabric.

2. A process according to claim 1 wherein said buffering agent comprises at least one salt of a weak acid and a strong base.

3. A process according to claim 1 wherein said buffering agent comprises sodium metaborate.

4. A process according to claim 1 wherein said catalyst comprises a blend of aluminum sulfate and magnesium sulfate and said buffering agent comprises sodium metaborate.

5. A process according to claim 1 wherein the formaldehyde-free finishing agent contains about 3 to about 75 parts by weight reactive silicone solids per 100 parts by weight glyoxal solids.

6. A process according to claim 1 wherein the impregnating of the fabric is carried out so as to provide a pick-up of about 1% to about 8% glyoxal and about $\frac{1}{3}$% to about 1% silicone, by weight, based on the dry weight of the fabric.

7. A process for imparting durable press properties to a textile fabric formed at least partially of cellulosic fibers and characterized by avoiding the use of formaldehyde and problems associated therewith, said method comprising impregnating the fabric with a formaldehyde-free finishing agent comprising glyoxal, reactive silicone, a durable press catalyst, and a salt of a weak acid and a strong base, drying the impregnated fabric, and heating the fabric to effect curing of the finishing agent and to impart durable press properties to the fabric.

8. A process according to claim 7 wherein said salt of a weak acid and a strong base comprises sodium metaborate.

9. A process according to claim 7 wherein said formaldehyde-free finishing agent contains about 3 to 75 parts by weight reactive silicone, about 5 to 40 parts durable press catalyst, and about 20 to 60 parts of said salt, by weight, solids basis, per 100 parts by weight glyoxal solids.

10. A durable press textile fabric produced in accordance with the process set forth in either one of claims 1 or 9.

11. A cured durable press textile fabric formed at least partially of cellulosic fibers, said fabric containing glyoxal and reactive silicone as fiber treating agents for said cellulosic fibers and imparting durable press properties to the fabric, and said fabric also containing a buffering agent for reducing the fabric acidity.

12. A treated textile fabric formed at least partially of cellulosic fibers and adapted for being cured by heating to impart durable press properties to the fabric but without the use of formaldehyde and problems associated therewith, said textile fabric containing an uncured formaldehyde-free finishing agent including as fiber treating agents a mixture of glyoxal and reactive silicone, and said fabric also containing a buffering agent for reducing the fabric acidity.

13. A textile fabric according to claim 11 or 12 wherein said buffering agent comprises at least one salt of a weak acid and a strong base.

14. A textile fabric according to claim 11 or 12 wherein said buffering agent comprises sodium metaborate.

15. A non-formaldehyde finishing agent for imparting durable press properties to a textile fabric formed at least partially of cellulosic fibers, said finishing agent comprising a formaldehyde-free aqueous composition containing glyoxal, reactive silicone, a durable press catalyst, and a buffering agent for reducing acidity in the treated fabric.

16. A finishing agent according to claim 15 wherein said buffering agent comprises at least one salt of a weak acid and a strong base.

17. A finishing agent according to claim 15 wherein said buffering agent comprises sodium metaborate.

18. A finishing agent according to claim 15 wherein said catalyst comprises a mixture of aluminum sulfate and magnesium sulfate and said buffering agent comprises sodium metaborate.

19. A finishing agent according to claim 15 containing about 3 to 75 parts reactive silicone, about 5 to 40 parts durable press catalyst, and about 20 to 60 parts buffering agent, by weight, solids basis, per 100 parts by weight glyoxal solids.

* * * * *

UNITED STATES PATENT AND TRADEMARK OFFICE

CERTIFICATE OF CORRECTION

PATENT NO. : 4,269,602
DATED : May 26, 1981
INVENTOR(S) : Daniel L. Worth

It is certified that error appears in the above-identified patent and that said Letters Patent are hereby corrected as shown below:

Column 2, line 40, "silicon" should be --silicone--

Column 3, line 35, "Pfeiffer" should be --Pfeffer--

Column 6, line 60, "Fabrics" should be --Fabric--

The inventor should be Daniel L. Worth

In the references, second column, (other Publications) lines 8 and 11, "Abs" should be --Abs.--; line 13, "Co" should be --Co.--; line 22, "Tous." should be --Jour.--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*